US012503772B2

(12) United States Patent
Sun et al.

(10) Patent No.: US 12,503,772 B2
(45) Date of Patent: Dec. 23, 2025

(54) METHOD FOR INCREASING WEAR RESISTANCE OF SURFACE OF CRANKSHAFT USING CERAMIC COATING

(71) Applicants: SHANDONG UNIVERSITY OF TECHNOLOGY, Shandong (CN); TIANRUN INDUSTRY TECHNOLOGY CO., LTD., Shandong (CN); SHANDONG TIANRUN ZHONGCHENG ADDITIVE MANUFACTURING CO., LTD., Shandong (CN)

(72) Inventors: Jun Sun, Shandong (CN); Jianchen Cong, Shandong (CN); Yongming Guo, Shandong (CN); Shibo Shao, Shandong (CN); Yangfan Zhou, Shandong (CN); Peixiang Ni, Shandong (CN)

(73) Assignees: SHANDONG UNIVERSITY OF TECHNOLOGY, Shandong (CN); TIANRUN INDUSTRY TECHNOLOGY CO., LTD., Shandong (CN); SHANDONG TIANRUN ZHONGCHENG ADDITIVE MANUFACTURING CO., LTD., Shandong (CN)

( * ) Notice: Subject to any disclaimer, the term of this patent is extended or adjusted under 35 U.S.C. 154(b) by 333 days.

(21) Appl. No.: 18/199,290

(22) Filed: May 18, 2023

(65) Prior Publication Data

US 2024/0167165 A1 May 23, 2024

(30) Foreign Application Priority Data

Nov. 17, 2022 (CN) ..... 202211461667.2

(51) Int. Cl.
*C23C 24/08* (2006.01)

(52) U.S. Cl.
CPC ..... *C23C 24/08* (2013.01)

(58) Field of Classification Search
CPC .... C23C 4/06; C23C 4/10; C23C 4/18; C23C 28/321; C23C 28/34; C23C 4/02
See application file for complete search history.

(56) References Cited

FOREIGN PATENT DOCUMENTS

SU 1442355 A1 * 12/1988
WO WO-2011092222 A1 * 8/2011 ..... F16C 3/08

OTHER PUBLICATIONS

SU-1442355-A1 English translation. (Year: 1988).*
WO-2011092222-A1 English translation. (Year: 2011).*

* cited by examiner

*Primary Examiner* — Hai Y Zhang
(74) *Attorney, Agent, or Firm* — SZDC Law PC

(57) ABSTRACT

The invention provides a method for increasing wear resistance of a surface of a crankshaft, including: dividing a journal of a crankshaft into a journal coating portion and two journal grinding portions located on two sides of the journal coating portion; the surface of the journal grinding portion is higher than that of the journal coating portion, and higher than the surface of the journal of a finished crankshaft, the surface of the rounded corner of the crankshaft is higher than that of the rounded corner of the finished crankshaft, and the size of the journal coating portion is smaller than that of the journal of the finished crankshaft; and spraying a ceramic coating on the surface of the journal coating portion, grinding the surfaces of the journal and the rounded corner until the ceramic coating and the surface of the rounded corner are seamlessly joined, and performing polishing.

9 Claims, 9 Drawing Sheets

METHOD FOR INCREASING WEAR RESISTANCE OF SURFACE OF CRANKSHAFT USING CERAMIC COATING

This application claims priority to Chinese Patent Application No. 202211461667.2, filed on Nov. 17, 2022, which is incorporated by reference for all purposes as if fully set forth herein.

FIELD OF THE INVENTION

The present invention relates to the field of crankshaft technologies, and in particular to a method for increasing wear resistance of a surface of a crankshaft using a ceramic coating.

DESCRIPTION OF THE RELATED ART

A crankshaft is one of the most important parts of an engine, and the reliability of the crankshaft is directly related to the stability of the entire engine. In recent years, with the implementation of Euro 6 and China 6 emission standards, engines have developed toward light weight, energy saving, and high speed, and the explosion pressure of engines keeps increasing. The maximum explosion pressure has increased from 160 bar to 180 bar during China 5 emission standards to 200 bar to 260 bar during China 6 emission standards, resulting in an increasing risk of a scoring failure in a crankshaft. Since the implementation of China 6 standards, the proportion of scoring in crankshafts in four- and six-cylinder engines has increased significantly, and scoring failures account for more than 30% of all failures, becoming the main factor affecting the reliability of engines. The main failure mechanism of scoring is that as the explosion pressure of an engine increases, an actual pressure on a journal of a crankshaft increases, and a fluid lubricating oil film tends to break. As a result, a friction pair of a crankshaft and a shell is in a boundary lubrication state. In the friction pair, local metal micro-convex bodies are in direct contact, causing severe wear and a lubrication failure. Therefore, how to reduce a friction coefficient of a surface of a crankshaft and reduce scoring and burning of the crankshaft becomes an urgent problem to be resolved to improve the reliability of the crankshaft.

At present, conventional treatments of a surface of a crankshaft mainly includes surface induction quenching and surface nitriding. However, in both treatments, a hardness difference in a friction pair of a journal and a shell is increased by improving surface hardness without changing a friction coefficient of a material, and friction resistance of the surface of the crankshaft is not fundamentally changed. Therefore, conventional crankshaft surface treatment technologies cannot adapt to requirements of engines with higher emission standards, and it is urgent to study new technologies and new methods to reduce a friction coefficient of a surface of a crankshaft, extend the service life of the crankshaft, reduce scoring and burning, and improve the overall reliability of engines.

SUMMARY OF THE INVENTION

For this, a technical problem to be resolved by the present invention is to overcome disadvantages in the prior art, and provide a method for increasing wear resistance of a surface of a crankshaft using a ceramic coating, which can reduce a friction coefficient of a surface of a crankshaft, increase the wear resistance of the surface of the crankshaft, reduce scoring and burning failures, and extend the service life of the crankshaft.

To resolve the foregoing technical problems, the present invention provides a method for increasing wear resistance of a surface of a crankshaft using a ceramic coating, including:

dividing a journal of a crankshaft before spraying into a journal coating portion and two journal grinding portions, where the two journal grinding portions are respectively located on two sides of the journal coating portion; and a surface of each journal grinding portion is higher than a surface of the journal coating portion, the surface of the journal grinding portion is higher than a surface of a journal of a finished crankshaft, a surface of a rounded corner of the crankshaft before spraying is higher than a surface of a rounded corner of the finished crankshaft, and a size of the journal coating portion is smaller than a size of the journal of the finished crankshaft in a radical direction of the journal; and spraying a ceramic coating on the surface of the journal coating portion, grinding a surface of the journal of the crankshaft and the surface of the rounded corner after the ceramic coating is sprayed until a surface of the ceramic coating and the surface of the rounded corner are seamlessly joined, and performing polishing to obtain the finished crankshaft.

Preferably, the surface of the rounded corner of the crankshaft before spraying is higher than the surface of the rounded corner of the finished crankshaft by 0.1 mm to 0.15 mm, and the size of the journal coating portion is smaller than the size of the journal of the finished crankshaft by 0.1 mm to 0.15 mm in the radical direction of the journal.

Preferably, a width of the journal grinding portion in a direction perpendicular to the radical direction of the journal ranges from 1 mm to 2 mm.

Preferably, the surface of the rounded corner of the crankshaft before spraying and the surface of the journal grinding portion are seamlessly joined, and a connection between the journal grinding portion and the journal coating portion is arc-shaped.

Preferably, before the ceramic coating is sprayed on the surface of the journal coating portion, a pretreatment is performed on the crankshaft before spraying, and the pretreatment includes quenching of the journal, protection of an oil hole in the journal, and a roughening treatment of the surface of the journal.

Preferably, the thickness of the ceramic coating in the radical direction of the journal ranges from 0.05 mm to 0.2 mm.

Preferably, the spraying a ceramic coating on the surface of the journal coating portion is specifically:

spraying a metal bonding bottom layer on the surface of the journal coating portion, where a thickness of the metal bonding bottom layer in the radical direction of the journal ranges from 0.05 to 0.10 mm; and spraying a uniform and dense ceramic coating on the surface of the journal coating portion, where a temperature of a heat source for spraying ranges from 2000° C. to 3500° C., and the temperature of the surface of the journal coating portion ranges from 80° C. to 150° C.

Preferably, during spraying of the ceramic coating, the distance of spraying ranges from 50 mm to 380 mm.

Preferably, a size of the journal after the grinding is greater than the size of the journal of the finished crankshaft by 0.004 mm to 0.006 mm in the radical direction of the journal.

Preferably, a roughness of the surface of the journal of the finished crankshaft ranges from 0.1 μm to 0.4 μm.

Compared with the prior art, the foregoing technical solution of the present invention has the following advantages:

In the present invention, a journal coating portion and journal grinding portions are provided on the surface of a journal, a ceramic coating of a specific thickness is sprayed on a surface of the journal coating portion, and then the surface of the journal is ground and polished to reach a design size of a finished crankshaft. The wear resistance of the crankshaft is significantly increased by spraying the ceramic coating, thereby reducing a friction coefficient of a surface of the crankshaft, extending the service life of the crankshaft, and significantly reducing probabilities of scoring and burning failures.

BRIEF DESCRIPTION OF THE DRAWINGS

To make the content of the present invention clearer and more comprehensible, the present invention is further described in detail below according to specific embodiments of the present invention and the accompanying draws. Where.

REFERENCE NUMERALS IN THE ACCOMPANYING DRAWINGS OF THE SPECIFICATION

Figure 1:
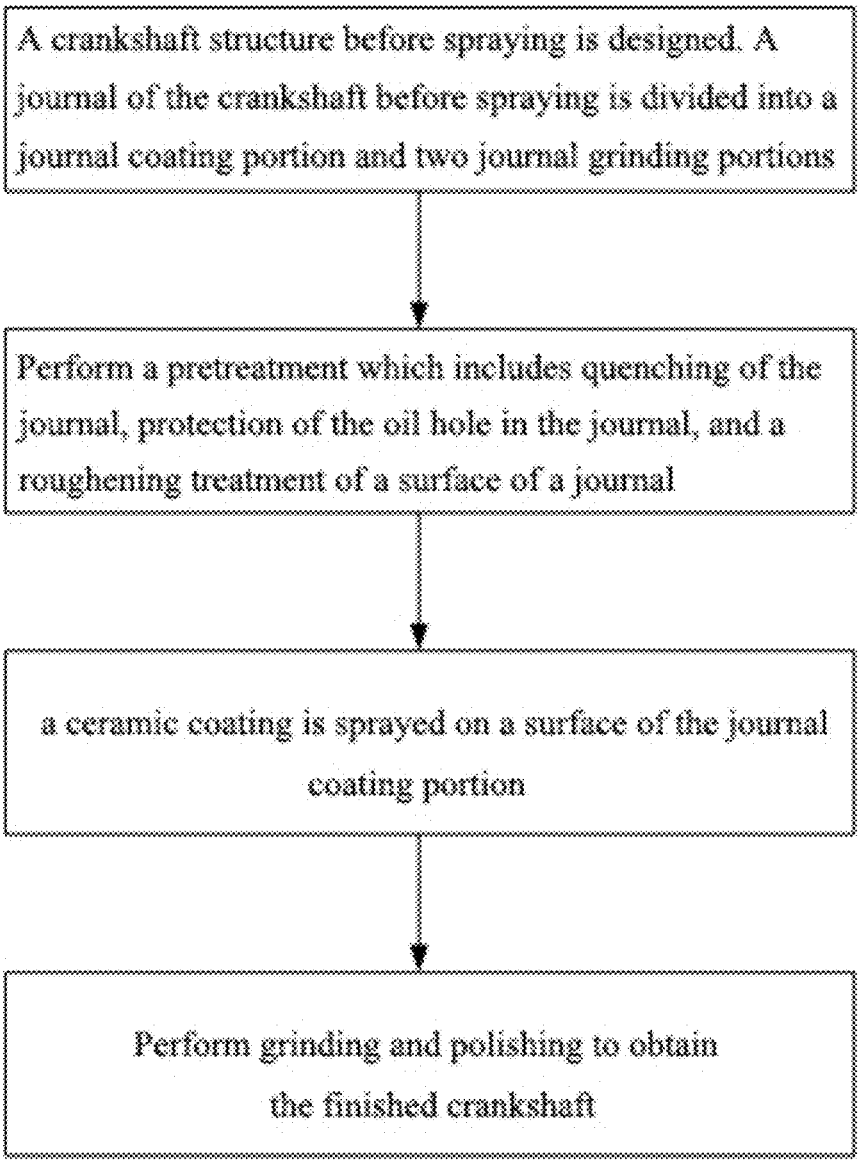
FIG. 1 is a flowchart of a method according to the present invention.

1. journal, 2. rounded corner, 3. contact between the journal and the rounded corner, 4. crank arm, 5. surface of journal before spraying, 6. surface of the journal of the finished crankshaft, 7. surface of the rounded corner before grinding, 8. surface of a rounded corner of the finished crankshaft, 9. ceramic coating, 10. journal grinding portion, 11. journal coating portion, 12. connection between the journal grinding portion and the journal coating portion, and 13. surface of the finished crankshaft.

DETAILED DESCRIPTION OF THE PREFERRED EMBODIMENTS

The present invention is further described below with reference to the accompanying drawings and specific embodiments, to enable a person skilled in the art to better understand and implement the present invention. However, the embodiments are not used to limit the present invention.

In the description of the present invention, it needs to be understood that orientation or location relationships indicated by terms "center", "up", "down", "front", "rear", "left", "right", "top", "bottom", "inside", "outside" are based on orientation or location relationships shown in the accompanying drawings, and are only used to facilitate description of the present invention and simplify description, but are not used to indicate or imply that the apparatuses or elements must have specific orientations or are constructed and operated by using specific orientations, and therefore, cannot be understood as a limit to the present invention. In addition, the terms "first" and "second" are used only for description, but are not intended to indicate or imply relative importance or implicitly specify a quantity of indicated technical features. Therefore, the features defined with "second" and "first" may explicitly or implicitly comprise one or more features. In the description of the present invention, the term "plurality of" means two or more, unless specifically and specifically limited otherwise.

In the present invention, unless otherwise expressly specified and defined, terms such as "mounted", "connected", "connection", and "fixed" should be understood in a broad sense, for example, fixedly connected, detachably connected or integrally connected; or mechanically connected or electrically connected; or communicatively connected; or connected directly or indirectly through an intermediate, or two elements communicated internally or two elements having mutual effects. A person of ordinary skill in the art may understand specific meanings of the foregoing terms in the present invention according to specific cases.

Unless expressly stated or limited otherwise, the expression of the first feature being "above" or "below" the second feature may include the case that the first feature is in direct contact with the second feature or include the case that the first feature and the second feature are in indirect contact through an intermediate. In addition, the term "include" is intended to cover a non-exclusive inclusion. For example, a process, method, system, product or device that includes a series of steps or units not only includes those specified steps or units, but optionally further includes steps or units that are not specified, or optionally further includes other steps or units that are inherent to these processes, methods, products or devices.

Figure 2:
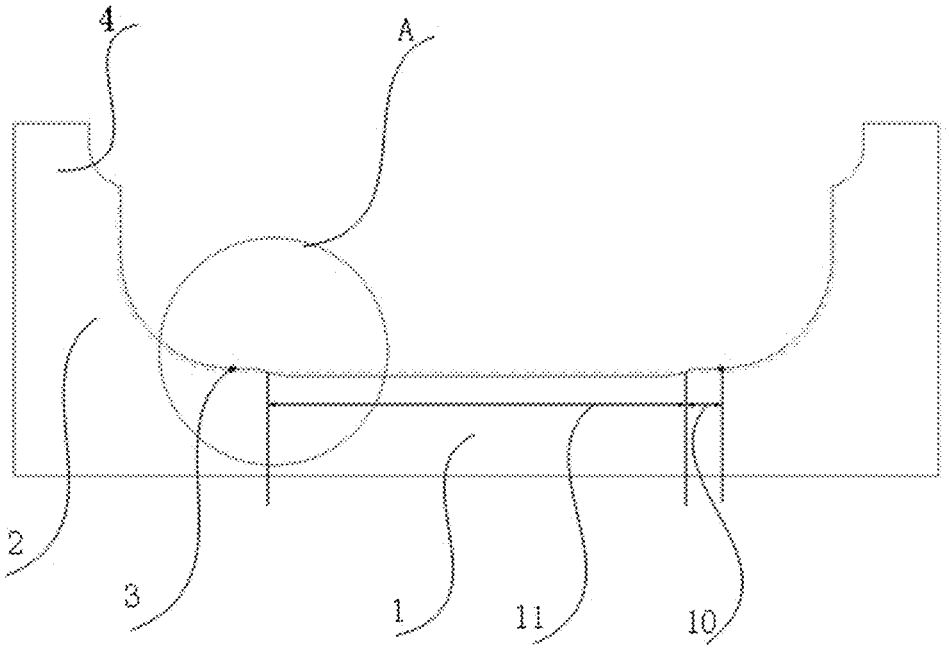
FIG. 2 is a schematic diagram of a crankshaft before spraying according to the present invention.
Figure 3:
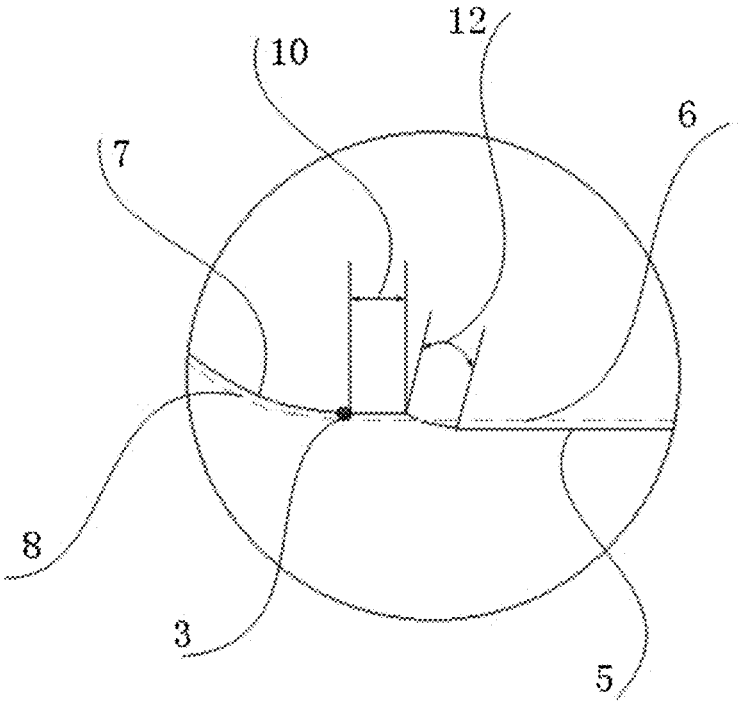
FIG. 3 is a partial enlarged view of a part A in FIG. 2.
Figure 4:
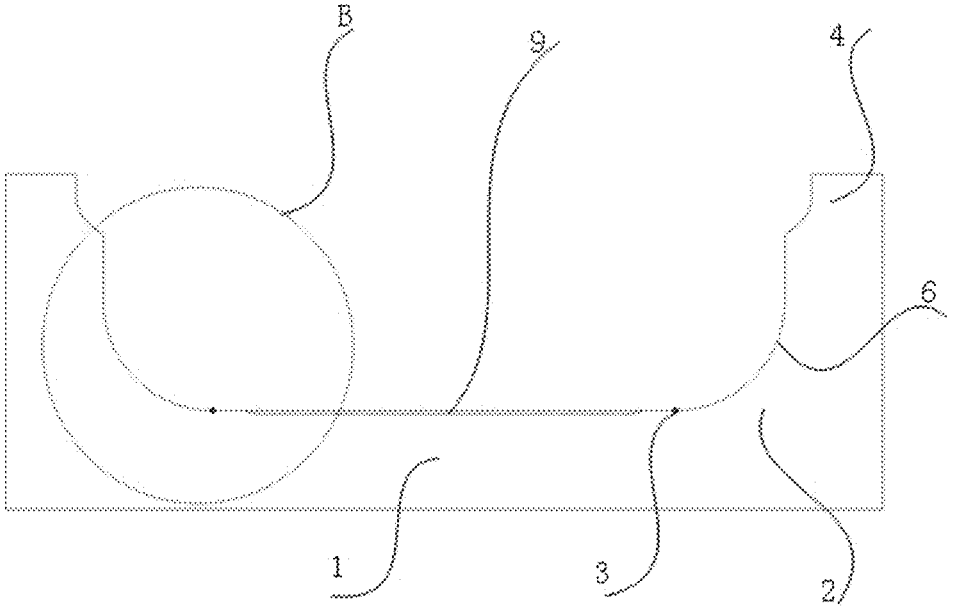
FIG. 4 is a schematic diagram of a finished crankshaft after spraying according to the present invention.
Figure 5:
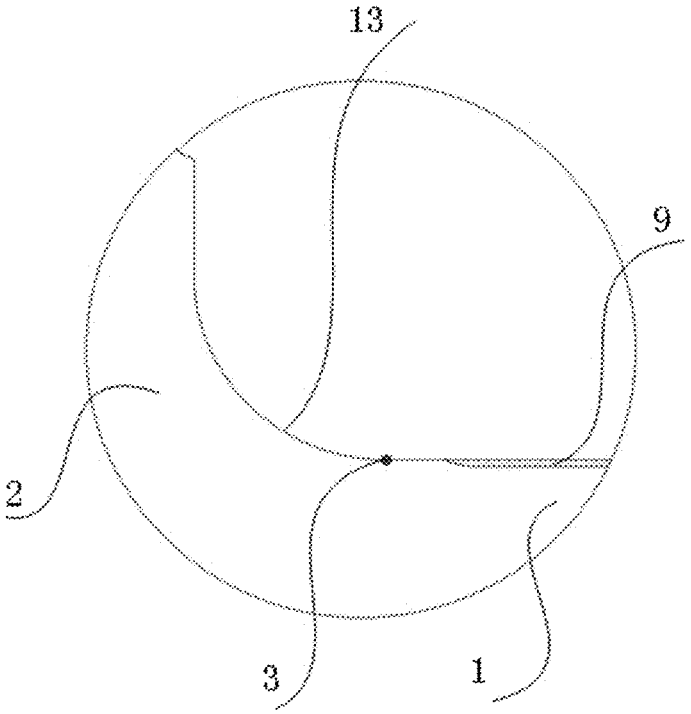
FIG. 5 is a partial enlarged view of a part B in FIG. 4.

With reference to the flowchart in FIG. 1, the present invention provides a method for increasing wear resistance of a surface of a crankshaft using a ceramic coating, including:

Step 1: as shown in FIG. 2 to FIG. 5, dash lines in FIG. 2 and FIG. 3 represent a surface 13 of a finished crankshaft (that is, a plane in which a surface 6 of a journal of the finished crankshaft and a surface 8 of a rounded corner of the finished crankshaft are located), solid lines in FIG. 2 to FIG. 5 represent a surface (that is, a plane in which a surface 5 before a journal is sprayed is located) of a crankshaft before spraying, and shaded parts in FIG. 4 and FIG. 5 represent a ceramic coating 9. A crankshaft structure before spraying is designed. It is defined that the size of the finished crankshaft is the design size of a crankshaft of an original engine. A journal 1 of the crankshaft before spraying is divided into a journal coating portion 11 and two journal grinding portions 10. A width of the journal coating portion 11 is between a width between contacts 3 between the journal and rounded corners on two sides and a width of an actual bearing plane of a shell. The two journal grinding portions 10 are respectively located on two sides of the journal coating portion 11. The surface of each journal grinding portion 10 is higher than the surface of the journal coating portion 11. The surface of the journal grinding portion 10 is higher than the surface 6 of the journal of the finished crankshaft. Before spraying, the surface of a rounded corner 2 of the crankshaft and the surface of the journal grinding portion 10 are seamlessly joined. The surface of the rounded corner 2 of the crankshaft before spraying is higher than the surface 8 of the rounded corner of the finished crankshaft. The size of the journal coating portion 11 is smaller than the size of the journal 1 of the finished crankshaft in a radical direction of the journal 1.

A gap between the journal 1 of the finished crankshaft and the shell is usually approximately 0.06 mm. According to different crankshafts, in this embodiment, the surface of the rounded corner 2 of the crankshaft before spraying is higher than the surface 8 of the rounded corner of the finished crankshaft by 0.1 mm to 0.15 mm. That is, in FIG. 3, the distance between a surface 7 of the rounded corner before grinding and the surface 8 of the rounded corner of the finished crankshaft ranges from 0.1 mm to 0.15 mm. The size of the journal coating portion 11 is smaller than the size of the journal 1 of the finished crankshaft by 0.1 mm to 0.15 mm in the radical direction of the journal 1. The width of the journal grinding portion 10 in a direction perpendicular to the radical direction of the journal 1 ranges from 1 mm to 2 mm. A sum of widths of the two journal grinding portions 10 on two sides ranges from 2 mm to 4 mm. A connection 12 between the journal grinding portion and the journal coating portion is arc-shaped. An arc shape is used at the connection for transition, so that the strength of the crankshaft can be ensured. To ensure a good joint at a connection between the ceramic coating 9 of the journal of the finished crankshaft and the rounded corner 2, a specific processing allowance is reserved for the rounded corner 2 before spraying. After spraying is completed, the rounded corner 2 and the ceramic coating on the journal 1 are then ground together to a finished size.

Step 2: Perform a pretreatment on the crankshaft before spraying, where the pretreatment includes quenching of the journal 1, protection of the oil hole in the journal 1, and a roughening treatment of a surface of a journal 1.

Step 2-1: Perform quenching of the crankshaft and previous processing procedures, which are conventional production processes. Details are not described herein.

Step 2-2: Perform protection of the oil holes in the journal 1 of the crankshaft before spraying. All oil holes on main shafts and rod journal 1, and oil hole chamfers are a protection area for spraying. A boundary of the protection area is a joint between an external contour of an oil hole chamfer and the surface of the journal 1.

Step 2-3: Perform a roughening treatment on the surface of the journal 1. Before spraying is performed, a sandblasting treatment is performed on the surface of the journal coating portion 11 by using sand grains, to roughen the surface, thereby increasing the binding force between a coating layer and the journal 1, and a roughness of the roughened surface reaches Ra5 μm to Ra10 μm.

Step 3: Spray the ceramic coating 9. After the pretreatment, the ceramic coating 9 is sprayed on the surface of the journal coating portion 11. The coating is sprayed only on the surface of the journal coating portion 11 of the journal 1, and the coating is not sprayed on the rounded corner 2 and other positions.

Step 3-1: Spray one metal bonding bottom layer on the surface of the journal coating portion 11, to increase the binding force between the ceramic and a matrix material of the crankshaft, where the thickness of the metal bonding bottom layer in the radical direction of the journal 1 ranges from 0.05 to 0.10 mm. The metal bonding bottom layer is made of Co, Ni, or an alloy material added with Cr, Al, and Y.

Step 3-2: Spray one uniform and dense ceramic coating 9 on the surface of the journal coating portion 11, where the temperature of the heat source for spraying ranges from 2000° C. to 3500° C., and the temperature of the surface of the journal coating portion 11 ranges from 80° C. to 150° C. The thickness of the ceramic coating 9 in the radical direction of the journal 1 ranges from 0.05 mm to 0.2 mm.

Figure 6:
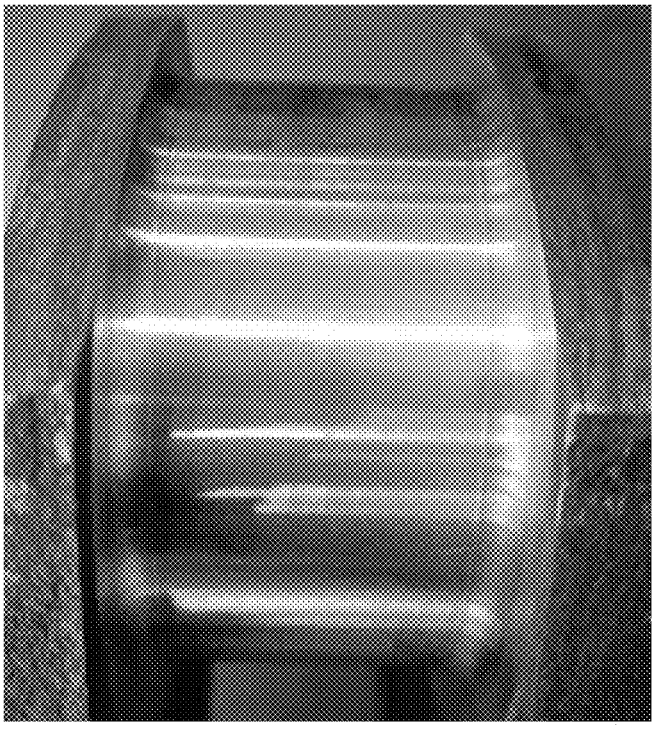
FIG. 6 is a schematic diagram of a surface of a journal of a crankshaft before spraying according to an embodiment of the present invention.
Figure 7:
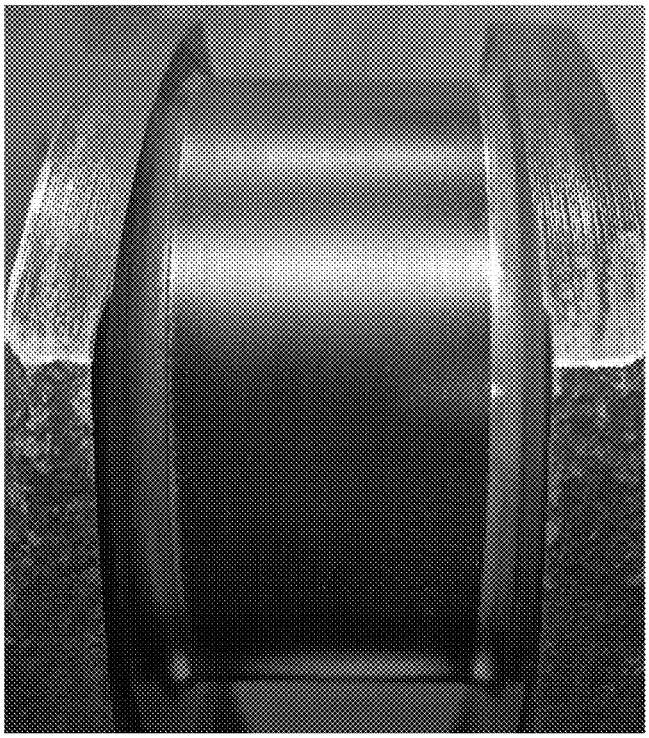
FIG. 7 is a schematic diagram of a surface of a journal of a crankshaft after a ceramic coating is sprayed according to an embodiment of the present invention.

During spraying of the ceramic coating 9, according to different spraying materials and spraying processes, the distance of spraying is adjusted between 50 mm and 380 mm. In this embodiment, a photo of the journal 1 of the crankshaft before spraying is shown in FIG. 6, and a photo of the journal 1 of the crankshaft after spraying is shown in FIG. 7. In this embodiment, ceramic is sprayed on the surface of the crankshaft, material components and coating processes are adjusted to stabilize the surface porosity of the ceramic between 5% and 7%. In this embodiment, the ceramic material may be a ceramic material dominated by aluminum oxide ($Al_2O_3$) or may be $ZrO_2$ stabilized by $Y_2O_3$, or the like.

Step 4: Perform grinding and polishing to obtain the finished crankshaft.

Step 4-1: Grind, with a grinding machine, the surface of the journal 1 of the crankshaft, the surface of the crank arm 4, and the surface of the rounded corner 2 after the ceramic coating 9 is sprayed, until the surface of the ceramic coating 9 and the surface of the rounded corner 2 are seamlessly joined, where the size of the journal 1 after grinding is greater than the size of the journal 1 of the finished crankshaft by 0.004 mm to 0.006 mm in the radical direction of the journal 1, and is 0.005 mm in this embodiment. A grinder is a CBN grinding wheel. The journal of the crankshaft and the surface of the rounded corner after spraying are ground simultaneously. The ceramic coating of the journal and an unsprayed metal surface are seamlessly joined, to ensure a smooth surface transition between the journal of the crankshaft and the rounded corner.

Step 4-2: Perform polishing on the surface to obtain the finished crankshaft. The journal 1 of the crankshaft and the rounded corner 2 are polished with a diamond abrasive band on an automatic abrasive polishing machine tool. The sizes of the journal 1 of the crankshaft and the rounded corner 2 after polishing reach finished sizes. The roughness of the surface of the journal 1 of the finished crankshaft ranges from Ra 0.1 μm to Ra 0.4 μm.

In the present invention, it is ensured that the journal of the finished crankshaft after spraying has a ceramic coating of a specific thickness, and the rounded corner is still a metal matrix, so that the friction wear resistance performance of the journal of the crankshaft is increased and the strength of the crankshaft is not lost.

In the present invention, a journal coating portion and a journal grinding portion are provided on a surface of a journal, a ceramic coating of a specific thickness is sprayed on a surface of the journal coating portion, and then the surface of the journal is ground and polished to reach a design size of a finished crankshaft. The wear resistance of the surface of the crankshaft is significantly increased by spraying the ceramic coating, thereby reducing a friction coefficient of the surface of the crankshaft. The ceramic layer on the surface of the crankshaft significantly reduces the friction coefficient between the crankshaft and a shell. A high porosity of the ceramic layer enhances the lubrication performance of the surface of the journal, so that probabilities of scoring and burning of the crankshaft are significantly reduced, and the service life is significantly extended. The main principle of improving tribological performance between the crankshaft and the shell by means of the ceramic coating includes several aspects as follows:

(1) The types of contact materials are changed. The friction pair of the journal of the crankshaft and the shell is changed from the original metal-metal pair into a ceramic-metal pair, so that an adhesive force in a friction pair caused by metal compatibility can be significantly reduced, thereby reducing a friction coefficient, and reducing the risk of adhesive wear.

(2) The ceramic material has high porosity, and has an oil storage function in terms of the microscopic structure. When the friction pair is in a boundary lubrication state, the lubricant that remains in material pores is pressed to flow out, so that the lubrication performance of the surface can be significantly enhanced.

(3) The surface of the ceramic material is in a mirror state after polishing. The roughness is significantly reduced compared with a conventional metal surface, thereby reducing the risk that local metal micro-convex bodies of the friction pair are in direct contact with each other.

(4) The ceramic material is less harmful. In a wear process, once falling off the surface of the matrix of the crankshaft, the ceramic material is very likely to be crushed into powder, to avoid three-body abrasive wear caused by falling off of the surface material, so that little contamination is caused to a friction surface.

Figure 8:
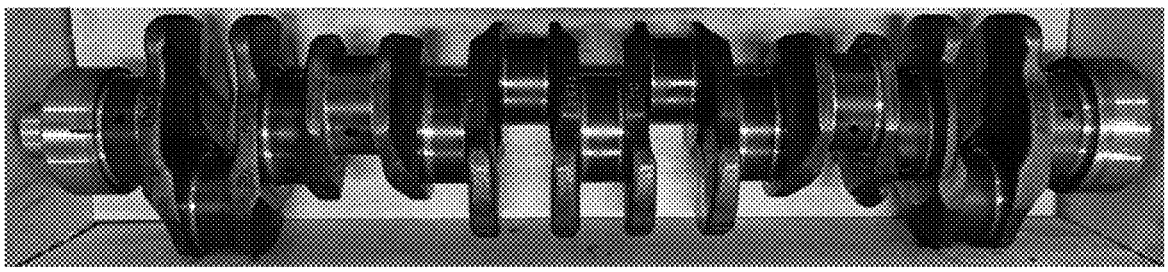
FIG. 8 shows a finished six-cylinder crankshaft after a ceramic coating is sprayed according to an embodiment of the present invention.
Figure 9:
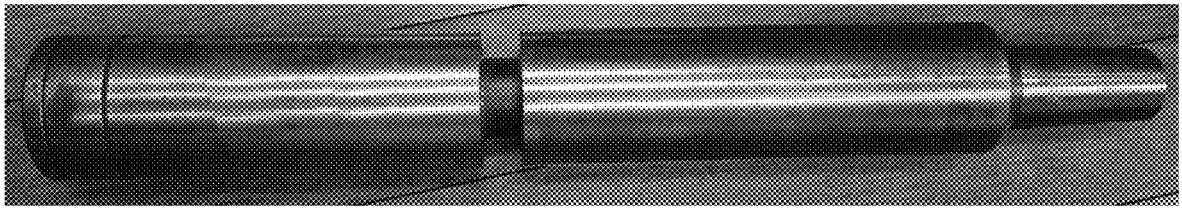
FIG. 9 shows a friction wear sample according to an embodiment of the present invention.

To further describe the beneficial effects of the present invention, in this embodiment, a crankshaft of a six-cylinder engine shown in FIG. 8 is studied. A friction wear sample with a ceramic coating on a surface obtained in the present invention and a conventionally produced sample without a ceramic coating are used to perform rotational friction experiments for comparison. A photo of the used sample is shown in FIG. 9. Rotational friction experiments are performed on the friction wear sample with a ceramic coating on a surface obtained in the present invention and the conventionally produced sample without a ceramic coating respectively in three experimental environments. The three experimental environments are shown in Table 1. The obtained experimental results are shown in Table 2.

TABLE 1

Table of settings of three experimental environments

| Experiment number | Experiment settings |
|---|---|
| Experiment 1 | A lubricant flow is 0.025 L/min. A lubrication system pressure is 0.45 MPa. A rotational speed is 1800 rpm. A pressure applied to the experimental journal is equal to the pressure when the engine is ignited. The engine runs for 30 minutes. A friction wear status is observed. |
| Experiment 2 | A lubricant flow is 0.025 L/min. A lubrication system pressure is 0.45 MPa. A rotational speed is 1800 rpm. The pressure applied to an experimental journal is equal to 120% of the pressure when the engine is ignited. The engine runs for 30 minutes. A friction wear status is observed. |
| Experiment 3 | A lubricant flow is 0.025 L/min. A lubrication system pressure is 0.45 MPa. A rotational speed is 1800 rpm. A pressure applied to an experimental journal is equal to a pressure when the engine is ignited. 1 g of iron filings with a grain size of 0.5 mm is added to a lubricant. The engine runs for 30 minutes. A friction wear status is observed. |

TABLE 2

Comparison table of results of three rotational friction experiments

Figure 10:
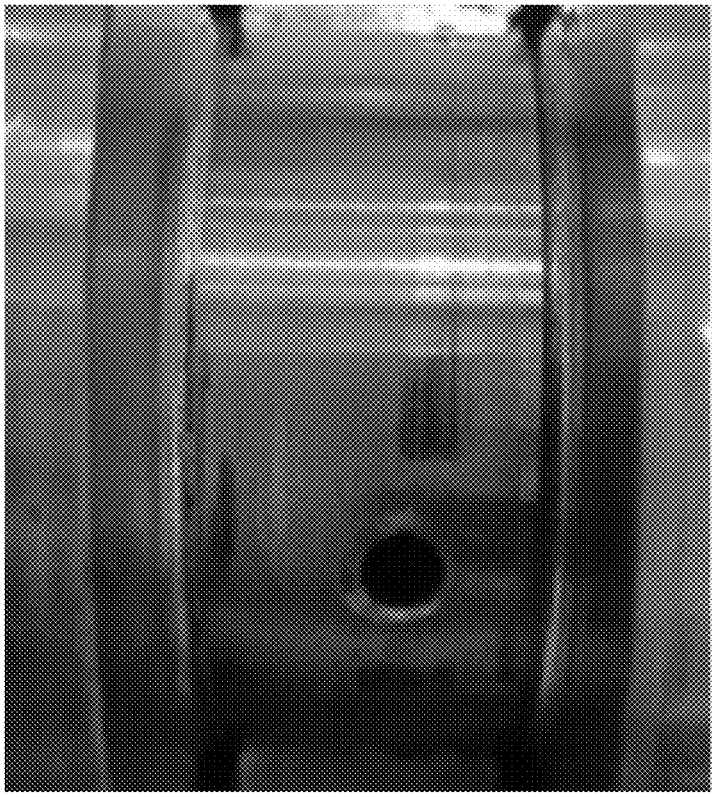
FIG. 10 shows experimental results of the middle of a journal of a sample with no ceramic coating sprayed in Experiment 2 according to an embodiment of the present invention.
Figure 11:
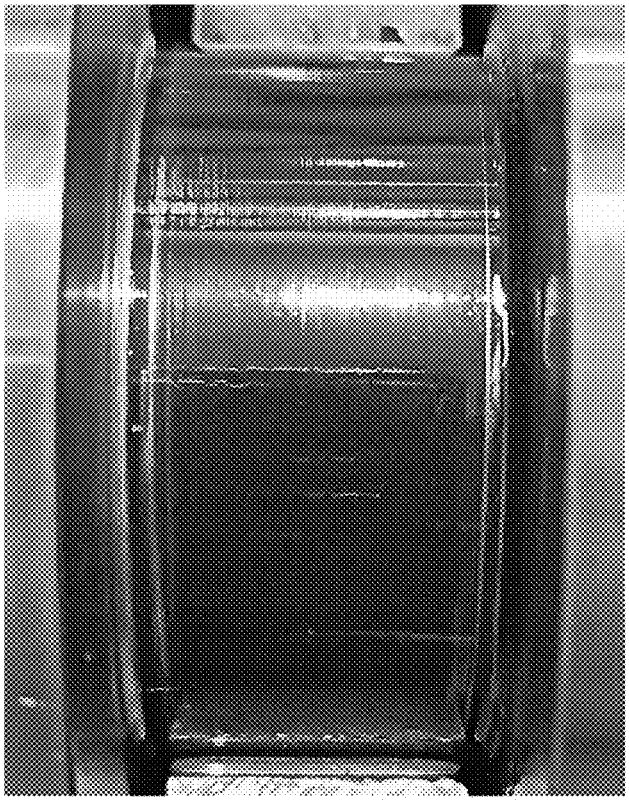
FIG. 11 shows experimental results of the middle of a journal of a sample with a ceramic coating sprayed in Experiment 2 according to an embodiment of the present invention.
Figure 12:
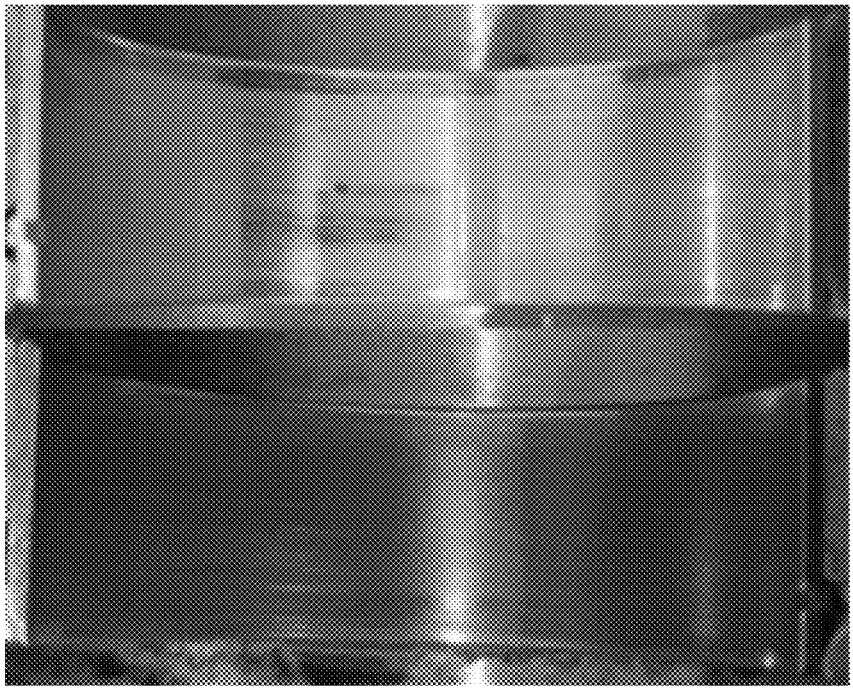
FIG. 12 is shows experimental results of upper and lower shells of a sample with no ceramic coating sprayed in Experiment 2 according to an embodiment of the present invention.
Figure 13:
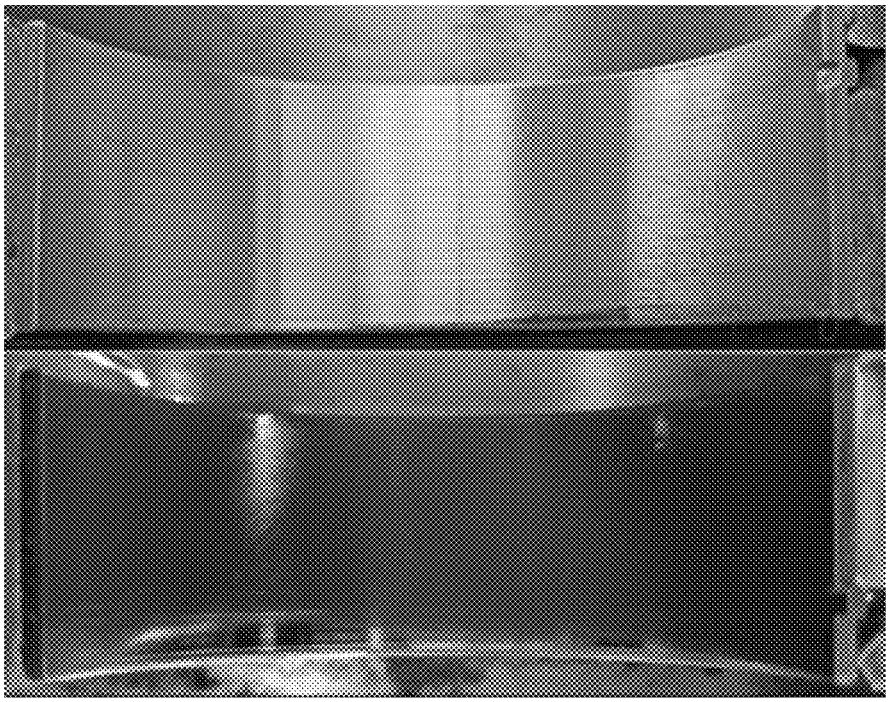
FIG. 13 shows experimental results of upper and lower shells of a sample with a ceramic coating sprayed in Experiment 2 according to an embodiment of the present invention.
Figure 14:
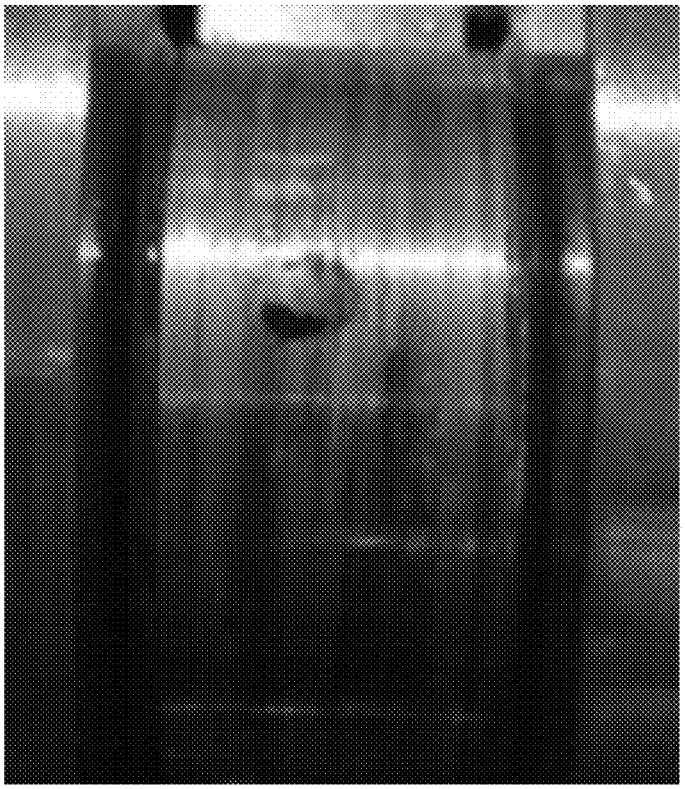
FIG. 14 shows experimental results of the middle of a journal of a sample with no ceramic coating sprayed in Experiment 3 according to an embodiment of the present invention.
Figure 15:
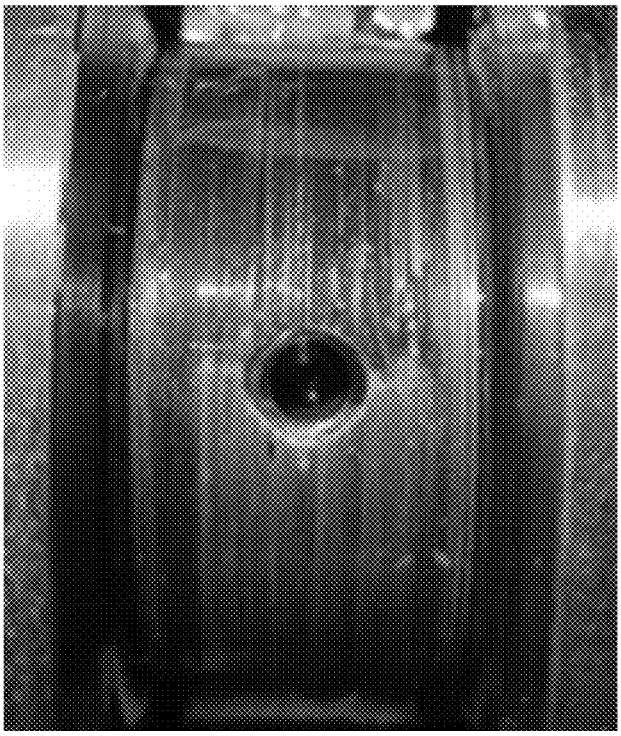
FIG. 15 shows experimental results of the middle of a journal of a sample with a ceramic coating sprayed in Experiment 3 according to an embodiment of the present invention.
Figure 16:
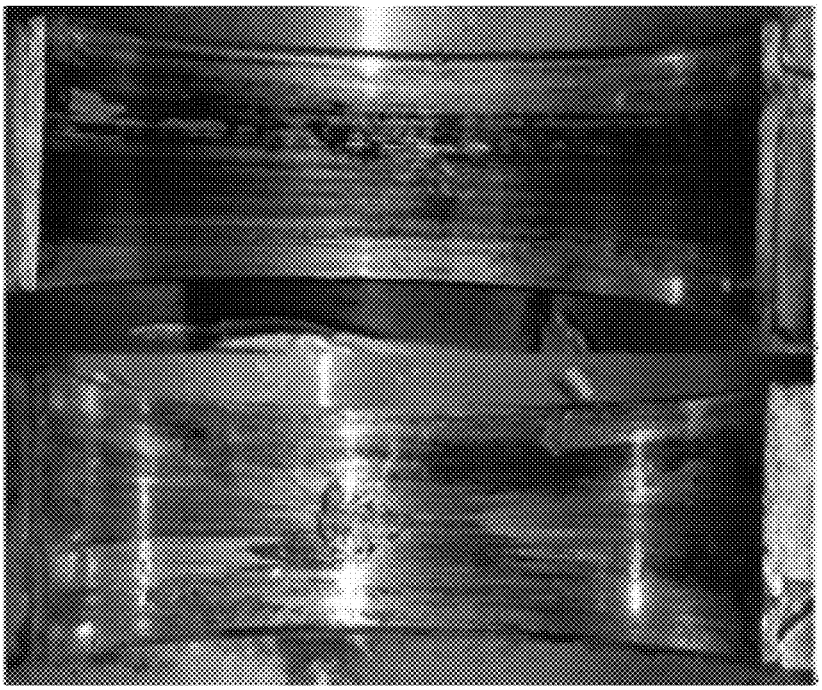
FIG. 16 shows experimental results of upper and lower shells of a sample with no ceramic coating sprayed in Experiment 3 according to an embodiment of the present invention.
Figure 17:
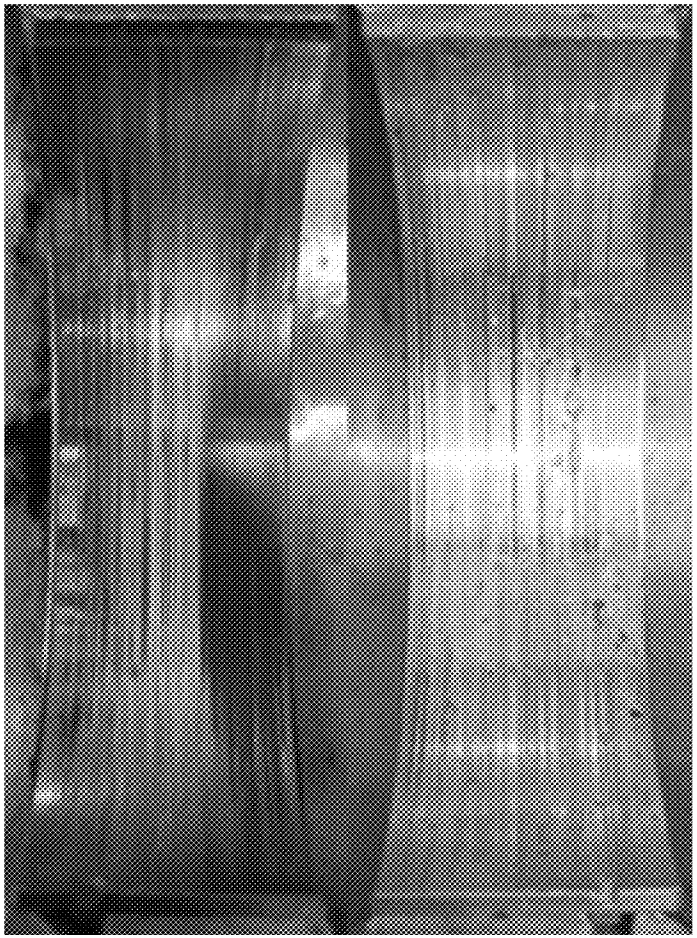
FIG. 17 shows experimental results of upper and lower shells of a sample with a ceramic coating sprayed in Experiment 3 according to an embodiment of the present invention.

| Sample status | Experiment number | Experimental result |
|---|---|---|
| Unsprayed sample | Experiment 1 | The journal has no wear, and the upper and lower shells have no wear. |
| | Experiment 2 | As shown in FIG. 10, the middle of a journal has slight wear. As shown in FIG. 12, the middle and edges of the upper and lower shells have slight wear. |
| | Experiment 3 | As shown in FIG. 14, the journal has severe wear. As shown in FIG. 16, the upper and lower shells have severe wear. The friction generates high heat to burn the upper and lower shells and the bearing cap together. |
| Sprayed sample | Experiment 1 | The journal has no wear, and the upper and lower shells have no wear. |
| | Experiment 2 | As shown in FIG. 11, the journal has no wear. As shown in FIG. 13, the edges of the upper and lower shells have slight wear. |
| | Experiment 3 | As shown in FIG. 15, the journal has a few friction scores. As shown in FIG. 17, the upper and lower shells have severe wear. The friction generates low heat, and shell and the bearing cap are not burned together. |

The holes on the journal in FIG. 10 to FIG. 17 are lubricant holes of the journal of the crankshaft, and the crankshaft itself has these holes. Experimental results of Experiment 1 do not have clear differences. Therefore, Experiment 2 continues to be performed. As can be seen from FIG. 10 to FIG. 13, under the same experimental conditions, for the crankshaft with a ceramic coating in the present invention, wear in the journal and the upper and lower shells is clearly mitigated. In Experiment 3, as can be seen from FIG. 14 to FIG. 17, for the crankshaft with a ceramic coating in the present invention, wear in the journal is clearly mitigated. The upper and lower shells have scores, but generated friction heat is very low as compared with the crankshaft without a ceramic coating. Therefore, the shell and the bearing cap are not burned together, and the wear resistance is further improved.

As can be comprehensively seen from Table 2, after a ceramic coating is sprayed, when an overpressure is loaded, wear in the journal of the crankshaft with a ceramic coating is clearly less than that in the crankshaft without a ceramic coating. When contact friction occurs between the journal and the shell, heat generated from friction in the crankshaft with a ceramic coating is clearly less than in the crankshaft without a ceramic coating, and no occlusion occurs between the journal and the shell in the crankshaft with a ceramic coating. In addition, the processing technologies of the present invention are advanced, and the process is feasible. Therefore, as can be seen from the experiments, the probabilities of scoring and burning of the crankshaft with a ceramic coating are significantly reduced. The crankshaft with a ceramic coating obtained in the present invention has reliable functions, so that the beneficial effects of the present invention are proved.

The foregoing embodiments are merely preferred embodiments used to fully describe the present invention, and the protection scope of the present invention is not limited thereto. Equivalent replacements or variations made by a person skilled in the art to the present invention all fall within the protection scope of the present invention. The protection scope of the present invention is as defined in the claims.

What is claimed is:

1. A method for increasing wear resistance of a surface of a crankshaft using a ceramic coating, comprising:

dividing a journal of a crankshaft before spraying into a journal coating portion and two journal grinding portions, wherein the two journal grinding portions are located on two sides of the journal coating portion respectively; and a surface of each journal grinding portion is higher than a surface of the journal coating portion, the surface of the journal grinding portion is higher than a surface of a journal of a finished crankshaft, a surface of a rounded corner of the crankshaft before spraying is higher than a surface of a rounded corner of the finished crankshaft, and a size of the journal coating portion is smaller than a size of the journal of the finished crankshaft in a radical direction of the journal; and spraying a ceramic coating on the surface of the journal coating portion, grinding a surface of the journal of the crankshaft and the surface of the rounded corner after the ceramic coating is sprayed until a surface of the ceramic coating and the surface of the rounded corner are seamlessly joined, and performing polishing to obtain the finished crankshaft, wherein the spraying a ceramic coating on the surface of the journal coating portion comprising:

spraying a metal bonding bottom layer on the surface of the journal coating portion, wherein a thickness of the metal bonding bottom layer in the radical direction of the journal ranges from 0.05 to 0.10 mm; and spraying a uniform and dense ceramic coating on the surface of the journal coating portion, wherein a temperature of a heat source for spraying ranges from 2000° C. to 3500° C., and a temperature of the surface of the journal coating portion ranges from 80° C. to 150° C., wherein the metal bonding bottom layer increases a binding force between the ceramic coating and journal coating portion.

2. The method for increasing wear resistance of a surface of a crankshaft using a ceramic coating according to claim 1, wherein the surface of the rounded corner of the crankshaft before spraying is higher than the surface of the rounded corner of the finished crankshaft by 0.1 mm to 0.15 mm, and the size of the journal coating portion is smaller than the size of the journal of the finished crankshaft by 0.1 mm to 0.15 mm in the radical direction of the journal.

3. The method for increasing wear resistance of a surface of a crankshaft using a ceramic coating according to claim 1, wherein a width of the journal grinding portion in a direction perpendicular to the radical direction of the journal ranges from 1 mm to 2 mm.

4. The method for increasing wear resistance of a surface of a crankshaft using a ceramic coating according to claim 1, wherein the surface of the rounded corner of the crankshaft before spraying and the surface of the journal grinding portion are seamlessly joined, and a connection between the journal grinding portion and the journal coating portion is arc-shaped.

5. The method for increasing wear resistance of a surface of a crankshaft using a ceramic coating according to claim 1, wherein before the ceramic coating is sprayed on the surface of the journal coating portion, a pretreatment is performed on the crankshaft before spraying, and the pretreatment comprises quenching of the journal, protection of an oil hole in the journal, and a roughening treatment of the surface of the journal.

6. The method for increasing wear resistance of a surface of a crankshaft using a ceramic coating according to claim 1, wherein a thickness of the ceramic coating in the radical direction of the journal ranges from 0.05 mm to 0.2 mm.

7. The method for increasing wear resistance of a surface of a crankshaft using a ceramic coating according to claim 1, wherein during spraying of the ceramic coating, a distance of spraying ranges from 50 mm to 380 mm.

8. The method for increasing wear resistance of a surface of a crankshaft using a ceramic coating according to claim 1, wherein a size of the journal after the grinding is greater than the size of the journal of the finished crankshaft by 0.004 mm to 0.006 mm in the radical direction of the journal.

9. The method for increasing wear resistance of a surface of a crankshaft using a ceramic coating according to claim 1, wherein a roughness of the surface of the journal of the finished crankshaft ranges from 0.1 μm to 0.4 μm.

* * * * *